US008869763B2

(12) United States Patent
Remala et al.

(10) Patent No.: US 8,869,763 B2
(45) Date of Patent: Oct. 28, 2014

(54) INTERNAL COMBUSTION ENGINE HAVING VALVE LIFTERS WITH MISALIGNMENT LIMITING END CAPS

(75) Inventors: Satish Remala, Peoria, IL (US); Sathishkumar Raman, Tamilnadu (IN)

(73) Assignee: Caterpillar Inc., Peoria, IL (US)

( * ) Notice: Subject to any disclaimer, the term of this patent is extended or adjusted under 35 U.S.C. 154(b) by 123 days.

(21) Appl. No.: 13/460,929

(22) Filed: May 1, 2012

(65) Prior Publication Data

US 2013/0291812 A1 Nov. 7, 2013

(51) Int. Cl.
*F01L 1/14* (2006.01)

(52) U.S. Cl.
USPC ..... 123/90.5; 123/90.52

(58) Field of Classification Search
USPC ..... 123/90.16, 90.52, 90.48, 90.5
See application file for complete search history.

(56) References Cited

U.S. PATENT DOCUMENTS

| | | | | |
|---|---|---|---|---|
| 2,207,324 | A * | 7/1940 | Orange | 92/73 |
| 3,886,808 | A | 6/1975 | Weber | |
| 4,721,074 | A | 1/1988 | Wirth et al. | |
| 4,724,804 | A | 2/1988 | Wirth | |
| 5,022,356 | A | 6/1991 | Morel, Jr. et al. | |
| 5,088,455 | A | 2/1992 | Moretz | |
| 5,263,386 | A | 11/1993 | Campbell et al. | |
| 6,357,407 | B2 | 3/2002 | Brothers | |
| 6,457,445 | B1 | 10/2002 | Sugawara | |
| 6,474,279 | B2 | 11/2002 | Faria | |
| 6,736,097 | B2 | 5/2004 | Riley | |
| 6,866,014 | B2 | 3/2005 | Spath | |
| 6,932,041 | B1 | 8/2005 | Riley | |
| 6,978,752 | B2 | 12/2005 | Albertson et al. | |
| 6,994,064 | B2 | 2/2006 | Haas et al. | |
| 7,121,244 | B2 | 10/2006 | Roe et al. | |
| 7,210,437 | B2 | 5/2007 | Geyer | |
| 7,565,890 | B2 * | 7/2009 | Keller et al. | 123/90.5 |
| 2005/0211212 | A1 | 9/2005 | Navak | |

FOREIGN PATENT DOCUMENTS

| | | |
|---|---|---|
| GB | 999507 | 7/1965 |
| JP | 2000-097004 A | 4/2000 |
| JP | 2001-329809 A | 11/2001 |

OTHER PUBLICATIONS

U.S. Appl. No. 13/332,534, filed Dec. 21, 2011.

* cited by examiner

*Primary Examiner* — Zelalem Eshete
(74) *Attorney, Agent, or Firm* — Liell & McNeil Attorneys, PC

(57) ABSTRACT

An internal combustion engine includes an engine housing defining a cylinder, and a first and a second gas exchange valve for the cylinder, positioned within the engine housing. The engine further includes a valve actuating mechanism having a first and a second valve lifter reciprocating within adjacent lifter bores to actuate the first and second gas exchange valves. Each of the first and second valve lifters includes an end cap having a misalignment limiting projection, limiting rotation of the valve lifter in response to dynamic perturbation.

18 Claims, 3 Drawing Sheets

INTERNAL COMBUSTION ENGINE HAVING VALVE LIFTERS WITH MISALIGNMENT LIMITING END CAPS

TECHNICAL FIELD

The present disclosure relates generally to limiting misalignment of valve lifters in an internal combustion engine, and relates more particularly to a valve lifter having an end cap with a misalignment limiting projection.

BACKGROUND

Valve lifters are commonly used in internal combustion engines to convert rotational motion of an engine cam into linear motion, for controlling the position of gas exchange valves. A typical design includes a lifter body coupled with a pushrod configured to actuate a rocker arm of one or more gas exchange valves. The lifter body includes a roller positioned in contact with the engine cam, such that rotation of the engine cam causes the valve lifter to slide within a lifter bore formed in the engine housing. Sliding of the valve lifter adjusts the pushrod, which in turn moves the rocker arm in a well-known manner.

In certain designs, valve lifters may become misaligned with the cam via rotation of the valve lifter within the lifter bore. The causes of such misalignment appear to vary from engine to engine. Even seemingly identical engine designs can exhibit different misalignment issues of their valve lifters over the course of the engine's service life. Adding to the complexity, some valve lifters tend to rotate more, or differently than other valve lifters even within the same engine.

Various strategies have been proposed over the years to limit rotation of valve train components. One technique employs an insert received in a space between adjacent valve train tappets. Great Britain Patent No. 999,507 to Price discloses such a design, where guiding faces on the insert cooperate with the tappets to restrain them against rotation in their bores. The design purportedly enables fuel-injection pumps to be constructed so that the distance between tappet bores is reduced. While Price may achieve its stated purposes, it is not without drawbacks, and appears purpose-built to solve problems which may be specific to certain reciprocating tappet systems.

SUMMARY

In one aspect, an internal combustion engine includes an engine housing defining a cylinder, and a first and a second lifter bore. The engine further includes a camshaft rotatably mounted to the engine housing and having a plurality of cams, and a first and a second gas exchange valve for the cylinder, positioned within the engine housing. The engine further includes a valve actuating mechanism including a first and a second valve lifter each contacting one of the cams and reciprocating within one of the first and second lifter bores in response to rotation of the camshaft, to actuate the first and second gas exchange valves, respectively. Each of the first and second valve lifters includes an end cap having a misalignment limiting projection, and the valve actuating mechanism has a first state where each of the first and second valve lifters is in alignment with the corresponding cam and a clearance extends between the projections, and a plurality of perturbed states where at least one of the first and second valve lifters is rotated out of alignment with the corresponding cam and the projections contact one another to limit the rotation.

In another aspect, a gas exchange system for a cylinder in an internal combustion engine includes a first and a second gas exchange valve configured to control fluid communications between the cylinder and a first and a second fluid conduit, respectively, formed in a housing of the internal combustion engine. The system further includes a camshaft having a plurality of cams and being configured to rotate within the housing, and a valve actuating mechanism for actuating the first and second gas exchange valves. The valve actuating mechanism includes a first and a second valve lifter, the first and second valve lifters defining parallel axes of reciprocation, and each being coupled with one of the first and second gas exchange valves. Each of the first and second valve lifters contacts one of the plurality of cams, such that the valve lifters reciprocate within adjacent lifter bores formed in the housing in response to rotation of the camshaft. The first and second valve lifters each include an end cap having a misalignment limiting projection, and the valve actuating mechanism is in a first state at which a clearance extends between the projections and the first and second valve lifters are in alignment with the corresponding cams. The valve actuating mechanism further assuming a dynamically induced perturbed state where at least one of the first and second valve lifters is rotated out of the alignment and the projections contact one another to limit the rotation.

In still another aspect, a valve lifter for a gas exchange valve actuating mechanism in an internal combustion engine includes an elongate lifter body defining a longitudinal axis, and having a pushrod bore formed therein. The elongate lifter body further includes a proximal body segment defining an opening to the pushrod bore, a distal body segment configured to receive a lifter roller for contacting a cam, and a middle body segment for guiding a lifter within a lifter bore formed in a housing of the internal combustion engine. The valve lifter further includes an end cap mated to the proximal body segment and being centered about the longitudinal axis. The end cap includes a proximal end, and a distal end held fast to the elongate lifter body, and having a through-bore formed therein and in communication with the pushrod bore. The end cap further includes a misalignment limiting projection extending in a radially outward direction and configured to contact a second misalignment limiting projection formed on a second end cape of a second valve lifter positioned in an adjacent lifter bore in the housing, to limit a rotation of the valve lifter out of alignment with the cam.

DETAILED DESCRIPTION

Figure 1:
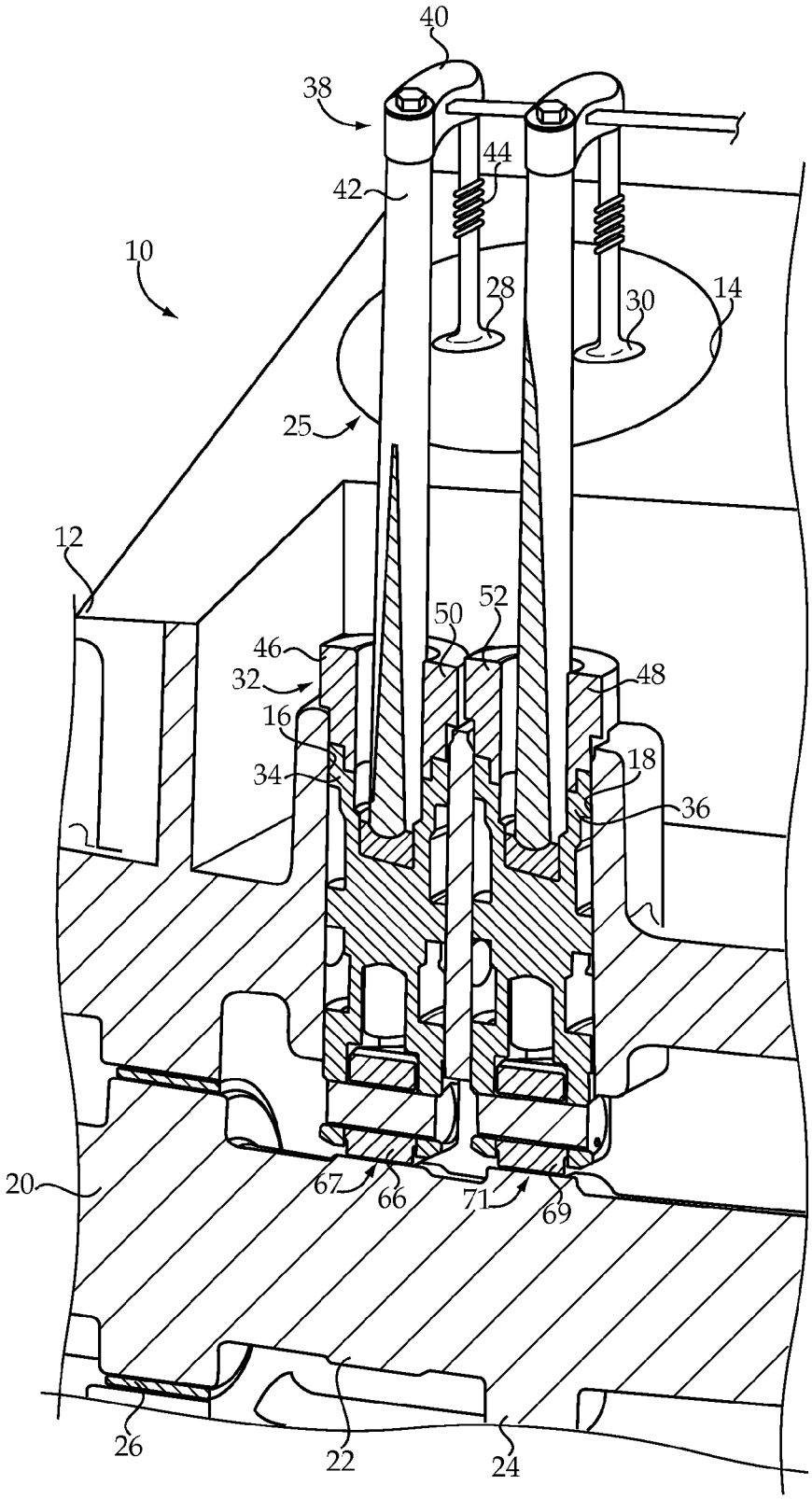
FIG. 1 is a partially sectioned side diagrammatic view of an internal combustion engine, according to one embodiment.

Referring to FIG. 1, there is shown an internal combustion engine 10 according to one embodiment. Engine 10 includes a housing 12, which may be a cylinder block, defining a cylinder 14. An engine head (not shown) will typically be mounted to housing 12, and having an intake conduit and an exhaust conduit formed therein in a conventional manner. Engine 10 may include a compression ignition diesel engine, and will typically be equipped with a fuel injector configured to directly inject a liquid diesel distillate fuel or the like into cylinder 14 for combustion therein. The present disclosure is not thereby limited, however, and certain spark-ignited, port-injected, or other engine configurations may fall within its scope. Housing 12 further defines a first lifter bore 16 and a second lifter bore 18. A camshaft 20 is rotatably mounted to housing 12 and has a plurality of cams 22 and 24. While engine 10 is shown having a single cylinder, and camshaft 20 illustrated having only two cams, in a practical implementation strategy engine 10 may include a plurality of cylinders, and a greater number of engine cams. Camshaft 20 is shown rotatably positioned within a cam bearing 26, and typically at least one additional cam bearing will be used to rotatably journal an opposite end of camshaft 20.

Engine 10 further includes a gas exchange system 25 having a first gas exchange valve 28 and a second gas exchange valve 30 for cylinder 14, which will be positioned within the engine head when engine 10 is assembled for service. One of gas exchange valves 28 and 30 may include an intake valve moveable between an open and a closed position to control fluid communications between cylinder 14 and an intake conduit formed in the engine head, whereas the other of gas exchange valves 28 and 30 may include an exhaust valve moveable between an open and a closed position to fluidly connect cylinder 14 with an exhaust conduit formed in the engine head. Embodiments are contemplated herein wherein two intake valves and two exhaust valves are associated with cylinder 14, but for simplicity's sake, only one of each are shown in FIG. 1.

Gas exchange system 25 may further include a valve actuating mechanism 32 having a first valve lifter 34 and a second valve lifter 36, each contacting one of cams 22 and 24 and reciprocating within first and second lifter bores 16 and 18, respectively, in response to rotation of camshaft 20. Reciprocation of first and second valve lifters 34 and 36 actuates first and second gas exchange valves 28 and 30, respectively. To this end, valve lifters 34 and 36 may be out of phase with one another to alternately connect cylinder 14 with the intake conduit and exhaust conduit at appropriate times during a four-phase engine cycle. Valve actuating mechanism 32 may further include a rocker arm linkage 38 coupling first gas exchange valve 28 with first valve lifter 34, and a second substantially identical rocker arm linkage (not numbered) coupling second gas exchange valve 30 with second valve lifter 36. As noted above, first and second valve lifters 34 and 36 may reciprocate out of phase with one another, between an advanced position at which the corresponding gas exchange valve is opened via the corresponding rocker arm linkage, and a retracted position at which it is closed. Rocker arm linkage 38 may include a rocker arm 40, a pushrod 42 and a return spring 44, whereas the rocker arm linkage associated with gas exchange valve 30 may include substantially the same components. Each of first and second valve lifters 34 and 36 may include an end cap 46 and 48, respectively, having a misalignment limiting projection 50 and 52, respectively. Projections 50 and 52 may cooperate with one another to limit rotation of the corresponding valve lifter 34 and 36 out of alignment with the corresponding cam 22 and 24, respectively, in a manner further described herein.

Figure 2:
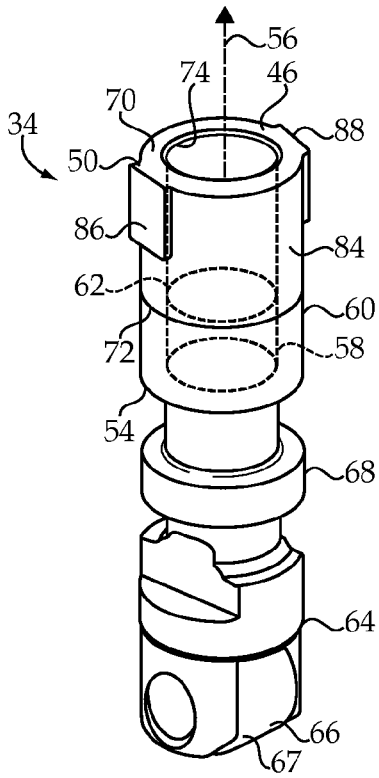
FIG. 2 is a diagrammatic view of a valve lifter suitable for use in the engine of FIG. 1.

Referring also now to FIG. 2, there is shown a diagrammatic view of valve lifter 34. Since valve lifters 34 and 36 may be identical, or at least substantially so, the present description of valve lifter 34 should be understood to analogously refer to valve lifter 36. Valve lifter 34 includes an elongate lifter body 54 defining a longitudinal axis 56. When placed for service within engine 10, valve lifter 34 may reciprocate along an axis of reciprocation co-linear with axis 56. Valve lifters 34 and 36 may have parallel axes of reciprocation in engine 10. Lifter body 54 may further have a pushrod bore 58 formed therein, and a proximal body segment 60 defining an opening 62 to pushrod bore 58. Lifter body 54 may further include a distal body segment 64 configured to receive a lifter roller 66 for contacting cam 22. Roller 66 may have a cylindrical outer cam contacting surface 67. Lifter body 54 further includes a middle body segment 68 for guiding lifter 34 within lifter bore 16. End cap 46 may be mated to proximal body segment 60 and centered about longitudinal axis 56. End cap 46 includes a proximal end 70, and a distal end 72 held fast to lifter body 54, such as via an interference fit. End cap 46 further has a through-bore 74 formed therein and in communication with pushrod bore 58.

As noted above, end cap 46 includes a misalignment limiting projection 50. In the illustrated embodiment, end cap 36 also includes a second misalignment projection 88 positioned 180° from misalignment projection 50, about longitudinal axis 56. The provision of two misalignment limiting projections enables valve lifter 34 to have two available and equivalent installation orientations for service within engine 10. Misalignment limiting projection 50 may extend in a radially outward direction and is configured to contact misalignment limiting projection 52 formed on end cap 48 when valve lifters 34 and 36 are positioned in adjacent lifter bores 16 and 18 in housing 12, to limit a rotation of each of valve lifters 34 and 36 out of alignment with the corresponding cam 22 and 24. End cap 46 may further include a cylindrical outer surface 84 which is circumferential of longitudinal axis 56 and defines a cylinder. Misalignment limiting projection 50, as well as projection 88, may have a rectangular shape and includes a planar outer face 86 positioned proximally of outer surface 84 and radially outward of the cylinder defined thereby. When each of valve lifters 34 and 36 is positioned for service in engine 10, misalignment limiting projections 50 and 52 may be understood to extend in radially outward directions from the corresponding elongate body such that planar face 86 is opposed to a second planar face of projection 52, as further discussed herein.

Figure 3:
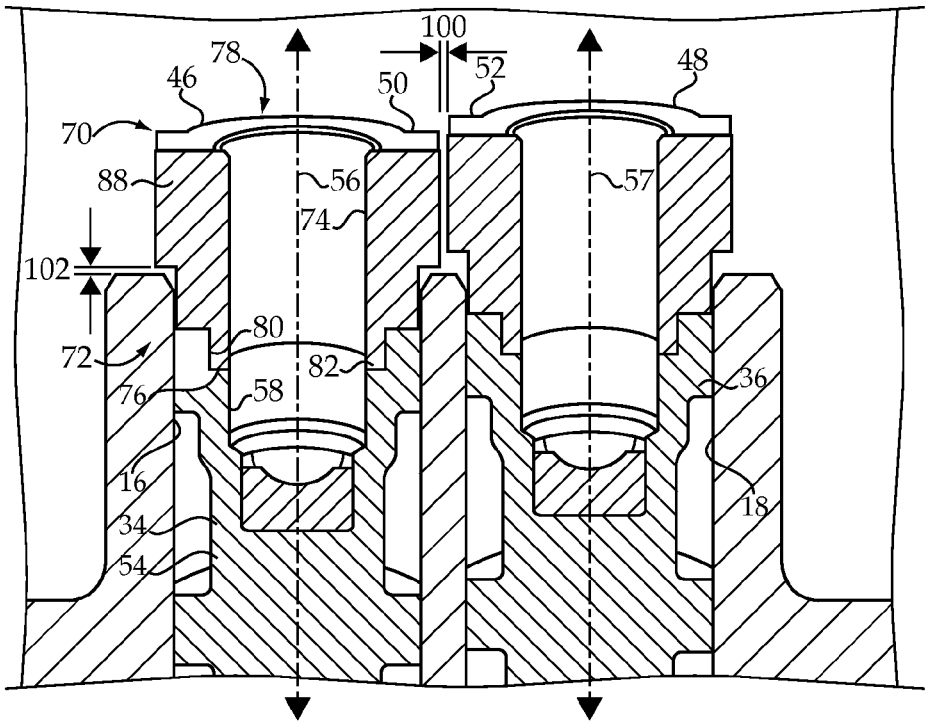
FIG. 3 is a sectioned view through a portion of the engine of FIG. 1.

Referring now to FIG. 3, there are shown valve lifters 34 and 36 adjacent one another within lifter bores 16 and 18. It will be recalled that end cap 46 may be mated to proximal body segment 60, and distal end 72 held fast to lifter body 54. End cap 46 may include a distal end face 76 abutting elongate body 54, and an exposed proximal end face 78. Proximal body segment 60 may define a counterbore 80 coaxial with pushrod bore 58, and distal end 72 may include a cylindrical projection 82 interference fit within counterbore 80. Additional or alternative strategies for attaching end cap 46 to body 54 might be used without departing from the scope of the present disclosure. For instance, end cap 46 might be welded to body 54. The respective mating features might also be reversed such that a cylindrical projection, or a projection having some other shape, is formed upon body 54 and received within a counterbore in end cap 46 via an interference fit or the like, or still some other attachment strategy might be used.

It may also be noted from FIG. 3 that misalignment limiting projection 50 extends for only part of an axial length of end cap 46 between faces 76 and 78. In other words, an axial length of misalignment limiting projection 50 may be less than an axial length of end cap 46. In certain embodiments, the axial length of projection 50 might be from one-third to two-thirds of the axial length of end cap 46. A clearance 102 extends in an axial direction between projection 50 and engine housing 12 when valve lifter 34 is positioned for service therein. In FIG. 3, valve lifter 34 is shown approximately as it might appear at a retracted position, where the corresponding gas exchange valve 28 is closed, whereas lifter 36 is shown approximately as it might appear, out of phase with valve lifter 46, at an advanced position where the corresponding gas exchange valve 30 is open. Clearance 102 will of course increase as lifter 34 is moved from its refracted position towards its advanced position, but will typically be sufficient such that projection 50 will always be spaced in an axial direction from engine housing 12.

Figure 4:
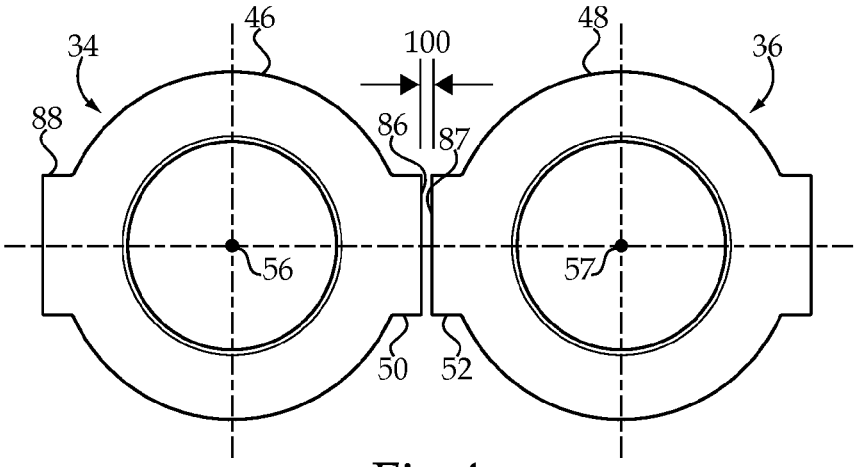
FIG. 4 is a top view of adjacent valve lifters in an internal combustion engine, in a first state.
Figure 5:
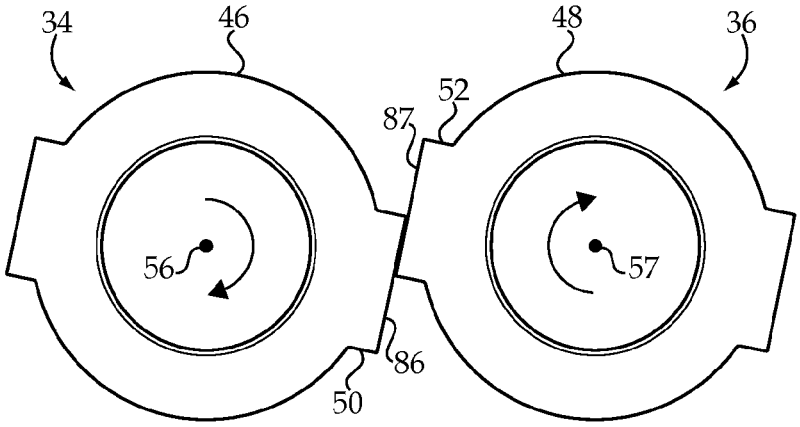
FIG. 5 is a top view of adjacent valve lifters similar to FIG. 4, in a perturbed state.

Referring also now to FIG. 4, there is shown a top view of valve lifters 34 and 36, and in particular illustrating valve lifters 34 and 36 as they might appear where positioned in alignment with their corresponding cams such that a clearance 100 extends between projections 50 and 52 and planar face 86 is parallel to a counterpart planar face 87 on end cap 48. From the state depicted in FIG. 4, one or both of valve lifters 34 and 36 may be perturbed such that they rotate out of alignment with the corresponding cam, and projections 50 and 52 contact one another to limit the rotation. Referring also to FIG. 5, there are shown valve lifters 34 and 36 where each has been rotated, and in the illustrated case they have been co-rotated, i.e. in the same direction, to a position at which projections 50 and 52 contact one another. It will be appreciated that a pattern of contact between projections 50 and 52 similar to that illustrated in FIG. 5 might be attained where only one of valve lifters 34 or 36 is rotated about its axis and the other remains in alignment with its corresponding cam. An analogous but reversed pattern of contact to that illustrated in FIG. 5 might be attained where valve lifters 34 and 36 are each rotated in opposite directions from those shown in FIG. 5, for instance each rotated counter-clockwise.

Figure 6:
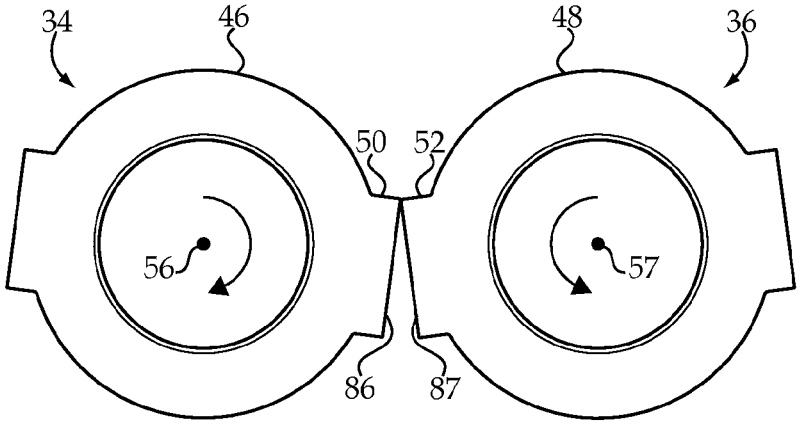
FIG. 6 is a top view of adjacent valve lifters similar to FIG. 4, in another perturbed state.

In FIG. 6, valve lifters 34 and 36 are shown as they might appear where counter-rotated about the respective axes 56 and 57 to positions at which projections 50 and 52 contact one another to limit the rotation. Again, an analogous but reversed pattern of contact might be attained by rotating valve lifters 34 and 36 in opposite directions from those depicted in FIG. 6. In view of FIGS. 5 and 6, it will be appreciated that valve actuating mechanism 32 may include a first and a second perturbed state where valve lifters 34 and 36 are co-rotated relative to one another, including the state shown in FIG. 5 and its analogous state attained by rotating valve lifters 34 and 36 in directions opposite to those shown, and a third and a fourth perturbed state where valve lifters 34 and 36 are counter rotated relative to one another, such as the state depicted in FIG. 6 and the state attained by rotating valve lifters 34 and 36 in directions opposite from those shown.

Industrial Applicability

Referring to the drawings generally, but in particular now back to FIG. 1, camshaft 20 will rotate during operation of engine 10 such that cams 22 and 24 cause valve lifters 34 and 36 to alternately advance and retract within lifter bores 16 and 18 to open and close valves 28 and 30. Roller 66 of valve lifter 34, and a roller 69 of valve lifter 36 will rotate in contact with cams 22 and 24. Cylindrical cam contacting surface 67 of roller 66 and a similar surface 71 of roller 69 may be designed to have a line contact pattern with the corresponding cam. Return spring 44 and the corresponding return spring associated with valve 30 will tend to urge the corresponding valve lifter against the corresponding cam, such that the valve lifters are biased to contact the corresponding cam according to the line contact pattern. In FIG. 1, valve lifters 34 and 36 are shown approximately as they might appear in a first state of engine 10/actuating mechanism 32, where they each have the desired line contact pattern with cams 22 and 24.

During operating engine 10, various dynamic forces can act upon valve lifters 34 and 36 to rotate either or both of them at any one time out of the desired line pattern of contact with the corresponding cam to assume an undesired pattern of contact, in other words such that engine 10/actuating mechanism 32 assumes a dynamically perturbed state. It has been observed that rotating valve lifters out of alignment with their cams can cause wear on various of the components, and in some instances lead to premature failure. The cooperation between misalignment limiting projections 50 and 52 as described herein addresses these concerns, and limits rotation of valve lifters 34 and 36 in response to engine dynamics. When the engine dynamics causing the rotation out of alignment subside or are cancelled out, for example, valve lifters 34 and 36 may settle back to the desired line contact pattern. During engine operation, the described perturbation and rotation-limiting actions may occur repeatedly as various forces, vibrations, temperature changes, and other phenomena are experienced. All the while, valve lifters 34 and 36 may reciprocate within their bores, with projections 50 and 52 contacting, bumping and/or sliding against one another to limit rotation.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. An internal combustion engine comprising:

an engine housing defining a cylinder, and a first and a second lifter bore spaced from one another such that a section of the engine housing extends therebetween;

a camshaft rotatably mounted to the engine housing and having a plurality of cams;

a first and a second gas exchange valve for the cylinder, positioned within the engine housing;

a valve actuating mechanism including a first and a second valve lifter each contacting one of the plurality of cams and reciprocating along parallel axes of reciprocation between a retracted position and an advanced position within one of the first and second lifter bores in response to rotation of the camshaft, to actuate the first and second gas exchange valves, respectively, and each of the first and second valve lifters including an end cap having a misalignment limiting projection;

the first and the second valve lifters further being positioned within the corresponding lifter bores such that the projections face one another and are located axially outward of the corresponding lifter bore at each of the retracted and advanced positions; and the valve actuating mechanism being in a first state where each of the first and second valve lifters is in alignment with the corresponding cam and a clearance extends between the projections, and the valve actuating mechanism being adjustable to a plurality of perturbed states where at least one of the first and second valve lifters is rotated out of alignment with the corresponding cam and the projections contact one another to limit the rotation.

2. The internal combustion engine of claim 1 wherein each of the first and second valve lifters includes a roller having a desired pattern of contact with the corresponding cam in the first state, and at least one of the rollers having an undesired pattern of contact with the corresponding cam in each of the plurality of perturbed states.

3. The internal combustion engine of claim 2 wherein each of the rollers includes a cylindrical cam contacting surface, and the desired pattern of contact includes a line contact pattern between the cylindrical cam contacting surface and the corresponding cam.

4. The internal combustion engine of claim 3 further comprising a first and a second rocker arm linkage coupling the first and second gas exchange valves, respectively, with the first and second valve lifters, and wherein the first and second valve lifters reciprocate out of phase with one another between the advanced position at which the corresponding gas exchange valve is opened via the corresponding rocker arm linkage, and the retracted position at which the corresponding gas exchange valve is closed.

5. The internal combustion engine of claim 4 wherein each of the first and second rocker arm linkages includes a return spring urging the corresponding valve lifter against the one of the cams, such that each of the first and the second valve lifters is biased to contact the one of the cams according to the line contact pattern.

6. The internal combustion engine of claim 5 wherein each of the valve lifters includes a body defining a pushrod bore receiving a pushrod of the corresponding rocker arm linkage, and wherein each of the end caps is held fast to the body and defines a through-bore in communication with the pushrod bore and receiving the pushrod therethrough.

7. The internal combustion engine of claim 6 wherein each of the misalignment limiting projections includes a planar face, and the planar faces are parallel in the first state.

8. The internal combustion engine of claim 2 wherein the plurality of perturbed states includes a first and a second perturbed state where the valve lifters are co-rotated relative to one another, and a third and a fourth perturbed state where the valve lifters are counter rotated relative to one another.

9. A gas exchange system for a cylinder in an internal combustion engine comprising:

a first and a second gas exchange valve configured to control fluid communications between the cylinder and a first and a second fluid conduit, respectively, formed in a housing of the internal combustion engine;

a camshaft having a plurality of cams and being configured to rotate within the housing;

a valve actuating mechanism for opening and closing the first and second gas exchange valves, including a first and a second valve lifter, and the first and second valve lifters defining parallel axes of reciprocation;

the first and second valve lifters each being coupled with one of the first and second gas exchange valves and contacting one of the plurality of cams, such that the valve lifters reciprocate along the parallel axes of reciprocation within adjacent lifter bores formed in the housing in response to rotation of the camshaft, and the first and second valve lifters each including a valve lifter body, and an end cap attached to the valve lifter body;

each of the end caps having a first misalignment limiting projection projecting in a first radially outward direction and a second misalignment limiting projection projecting in a second radially outward direction, the second radially outward direction being opposite the first radially outward direction, such that each of the first and second valve lifters has two available installation orientations for service within the internal combustion engine;

the valve lifter bodies being spaced from one another and positioned such that two of the projections extend toward one another across the spacing between the valve lifter bodies, and the other two of the projections extend away from one another; and the valve actuating mechanism being in a first state in which a clearance extends between the projections extending toward one another and the first and second valve lifters are in alignment with the corresponding cams, and the valve actuating mechanism assuming a dynamically induced perturbed state where at least one of the first and second valve lifters is rotated out of the alignment and the projections contact one another to limit the rotation.

10. The system of claim 9 wherein each of the valve lifter bodies includes an elongate body having a proximal end, and a distal end with a roller rotatably positioned therein and contacting the corresponding cam, and wherein the proximal end defines an opening to a pushrod bore extending longitudinally in the elongate body.

11. The system of claim 10 wherein each of the end caps defines a through-bore in communication with the corresponding pushrod bore, and the misalignment limiting projections include opposed planar faces.

12. The system of claim 10 wherein the first gas exchange valve includes an intake valve, the second gas exchange valve includes an exhaust valve, and the first and second valve lifters reciprocate out of phase with one another in response to the rotation of the camshaft.

13. The system of claim 10 wherein each of the end caps includes an exposed proximal end face positioned in part upon the corresponding misalignment limiting projection, and a distal end face abutting the elongate body.

14. A valve lifter for a gas exchange valve actuating mechanism in an internal combustion engine comprising:

an elongate lifter body defining a longitudinal axis, and having a pushrod bore formed therein, the elongate lifter body further including a proximal body segment defining an opening to the pushrod bore, a distal body segment configured to receive a lifter roller for contacting a cam, and a middle body segment having a cylindrical outer surface extending circumferentially around the longitudinal axis, for guiding the lifter within a lifter bore formed in a housing of the internal combustion engine;

an end cap mated to the proximal body segment and being centered about the longitudinal axis, the end cap including a proximal end, and a distal end held fast to the elongate lifter body, and having a through-bore formed therein and in communication with the pushrod bore; and the end cap further including a first misalignment limiting projection extending in a first radially outward direction and configured to contact a second misalignment limiting projection formed on a second end cap of a second valve lifter positioned in an adjacent lifter bore in the housing, to limit a rotation of the valve lifter out of alignment with the cam, the end cap further including a second misalignment limiting projection extending in a second radially outward direction, the first radially outward direction being opposite the second radially outward direction, and each of the misalignment limiting projections having a rectangular shape with a major diameter oriented parallel to the longitudinal axis.

15. The valve lifter of claim 14 wherein the end cap includes a distal end face abutting the elongate body, and an exposed proximal end face formed in part on each of the first and second misalignment limiting projections.

16. The valve lifter of claim 15 wherein the proximal body segment defines a counterbore coaxial with the pushrod bore, and the distal end of the end cap includes a cylindrical projection interference fit within the counterbore.

17. The valve lifter of claim 16 wherein the end cap includes a cylindrical outer surface disposed around the longitudinal axis and defining a cylinder, and wherein each of the misalignment limiting projections has a rectangular shape and includes a planar outer face positioned proximally to the cylindrical outer surface and radially outward of the cylinder defined thereby.

18. The valve lifter of claim 16 wherein the end cap has a first axial length extending from the proximal end face to the distal end face, and each of the misalignment limiting projections has a second axial length shorter than the first axial length, such that another clearance extends in an axial direction between the projection and the engine housing when the valve lifter is positioned for service therein.

* * * * *

UNITED STATES PATENT AND TRADEMARK OFFICE

CERTIFICATE OF CORRECTION

PATENT NO. : 8,869,763 B2
APPLICATION NO. : 13/460929
DATED : October 28, 2014
INVENTOR(S) : Remala et al.

It is certified that error appears in the above-identified patent and that said Letters Patent is hereby corrected as shown below:

In the specification

Column 5, line 52, delete "Industrial Applicability" and insert -- INDUSTRIAL APPLICABILITY --.

Signed and Sealed this
Twenty-fourth Day of November, 2015

Michelle K. Lee

Michelle K. Lee
*Director of the United States Patent and Trademark Office*